US006128975A

United States Patent [19]

Schley et al.

[11] Patent Number: 6,128,975

[45] Date of Patent: Oct. 10, 2000

[54] HOSE CLAMP PLIERS & METHOD

[76] Inventors: Paul E. Schley, 5350 E. Hunter Ave., Anaheim Hills, Calif. 92807-2053; Timothy P. Hume, 1653 N. Dressage St., Orange, Calif. 92869

[21] Appl. No.: 09/042,818

[22] Filed: Mar. 17, 1998

Related U.S. Application Data

[63] Continuation-in-part of application No. 08/609,799, Mar. 1, 1996, abandoned.

[51] Int. Cl.[7] ..... B25B 27/10

[52] U.S. Cl. ..... 81/9.3; 29/426.5; 29/229

[58] Field of Search ..... 29/229, 225, 227, 29/235, 426.5; 81/9.3, 319, 325, 328, 386, 388, 389, 390, 398, 399, 400, 401, 402, 403, 404, 341, 427.5

[56] References Cited

U.S. PATENT DOCUMENTS

| | | |
|---|---|---|
| 562,719 | 6/1896 | Freeman . |
| 936,980 | 10/1909 | Bing . |
| 1,426,553 | 8/1922 | Cruickshank . |
| 1,478,942 | 12/1923 | Cook . |
| 2,677,982 | 5/1954 | Arras et al. . |
| 2,898,789 | 8/1959 | Meese . |
| 3,013,456 | 12/1961 | Ericson . |
| 3,111,870 | 11/1963 | Anderson . |
| 3,145,388 | 8/1964 | Carpinella . |
| 3,161,086 | 12/1964 | Kircher . |
| 3,242,560 | 3/1966 | Mitchell . |
| 3,608,404 | 9/1971 | Sarvie . |
| 3,656,679 | 4/1972 | Minasy . |
| 4,162,640 | 7/1979 | Arnold . |
| 4,478,532 | 10/1984 | Puro . |
| 4,614,001 | 9/1986 | Liou . |
| 5,022,291 | 6/1991 | McBain . |
| 5,140,734 | 8/1992 | Taggart . |
| 5,253,554 | 10/1993 | Riera et al. . |
| 5,507,206 | 4/1996 | Solski . |
| 5,590,573 | 1/1997 | Detable . |
| 5,865,072 | 2/1999 | Jerdee . |

FOREIGN PATENT DOCUMENTS 92 16 463 U 12/1992 Germany .

OTHER PUBLICATIONS

Hazet, 2 pages, No Date.

*Primary Examiner*—Irene Cuda

*Attorney, Agent, or Firm*—John J. Connors; Connors & Assoc.

[57] ABSTRACT

Adjustable pliers for a constant tension hose clamp include a pair of arms pivotally connected together at intermediate portions of the arms. Each arm has a handle portion and a gripping portion, and the gripping portions have opposed ends that are spaced apart a predetermined distance. Each end has a grasping element, with each grasping element adapted to hold one actuating member of the hose clamp. This enables the hose clamp to be held by the grasping elements between the gripping portions to enlarge the diameter of the hose clamp by pressing the handle portions together. One of the arms has two separate sections, a gripper section and a handle section. These sections are rigidly connected together by an adjustable rod mechanism that enables the two sections to be moved relative to each other to change the angular relationship between the two sections by adjustment of the rod mechanism.

20 Claims, 18 Drawing Sheets

FIG. 22B
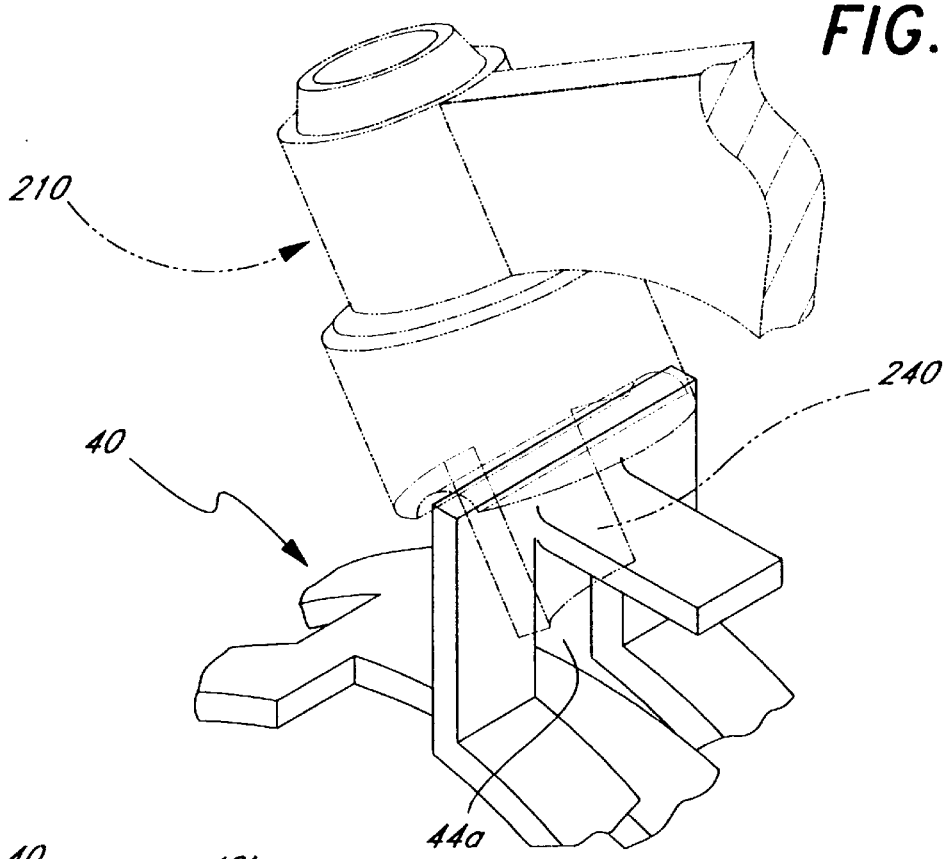
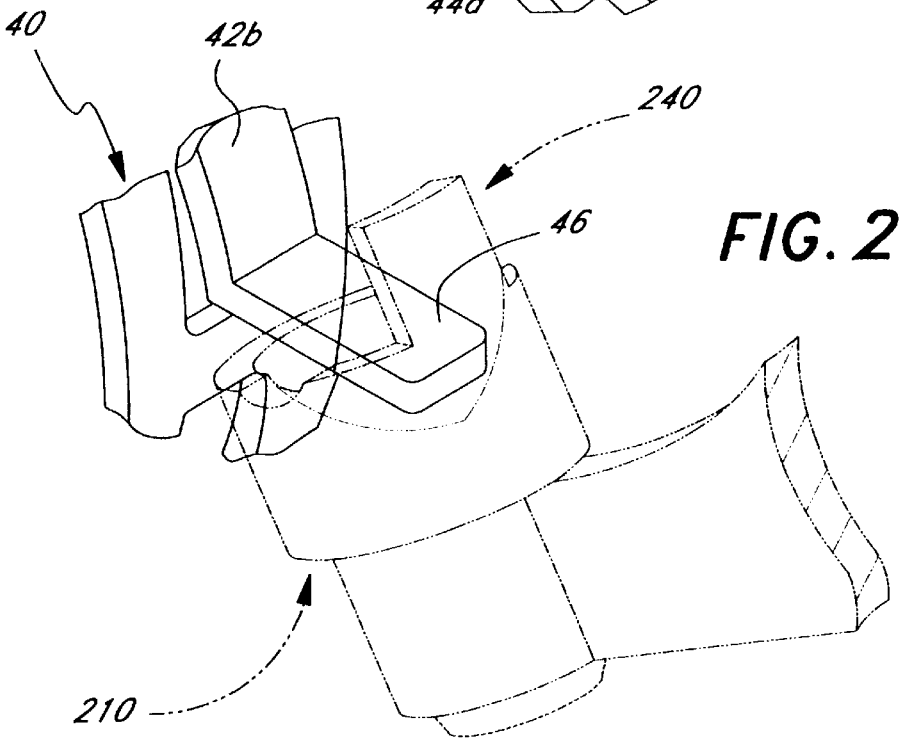
FIG. 22C

FIG. 23
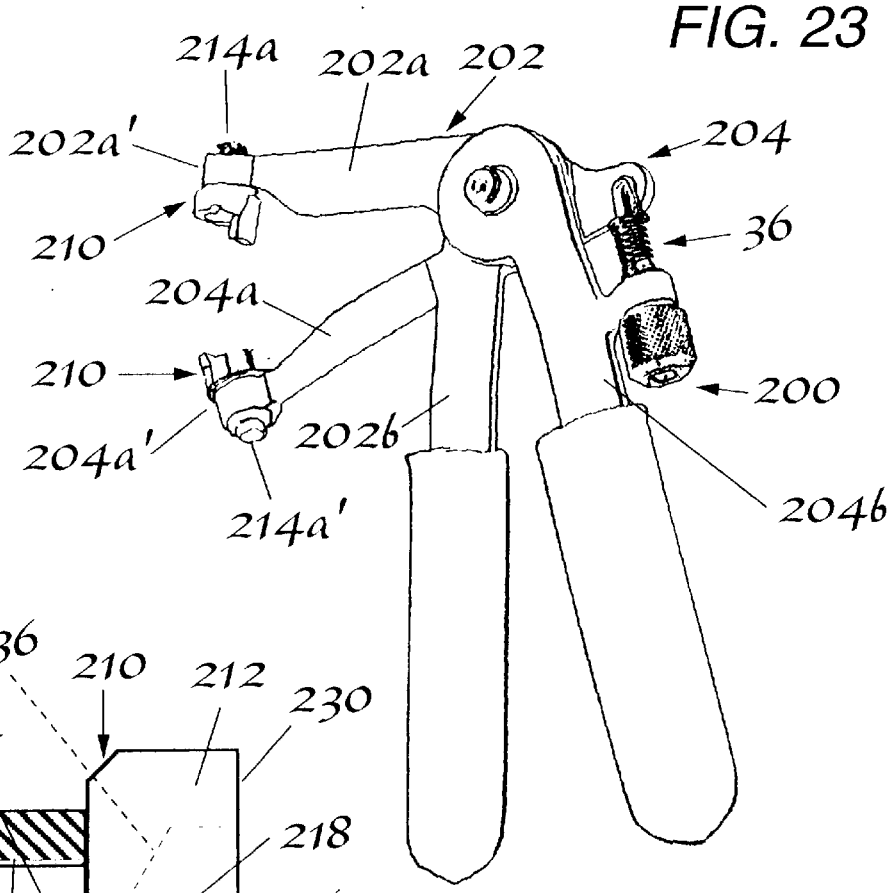
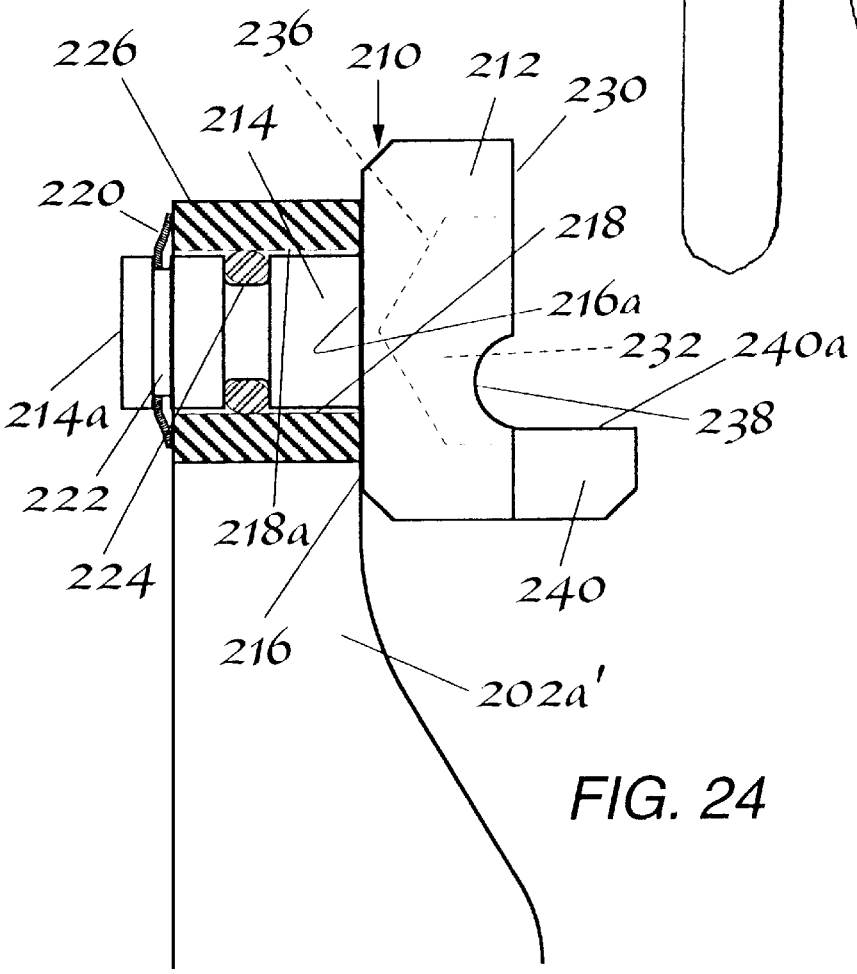
FIG. 24

HOSE CLAMP PLIERS & METHOD

RELATED PATENT APPLICATIONS

This application is a continuation-in-part application of U.S. Ser. No. 08/609,799, entitled "Adjustable Hose Clamp Pliers," filed Mar. 1, 1996, now abandoned, which is incorporated herein by reference and made a part of this application.

BACKGROUND OF THE INVENTION

1. Field of the Invention

This invention relates to a hose clamp pliers which is compact, allowing easy access to hose components used on automotive engines which are situated in difficult to reach locations.

2. Background Discussion

The aerodynamic design of automotive vehicles such as cars, trucks, campers, etc. has been improved in order to reduce consumption of gasoline. This has resulted in a low profile engine compartment that is closed to ground level with very little unoccupied space. Typically, hoses for carrying cooling liquids, or other fluids for the engine, employ constant tension hose clamps. These hose clamps are in the form of a spring, comprising essentially a loop of spring steel having outwardly extending actuating members. Specifically, the clamp is circular loop-type member having a pair of overlapping clamp ends. Each clamp end has an actuating member thereon. The actuating member at one clamp end has a first finger and the other actuating member at the other clamp end end has a yoke with a second finger thereon. When these actuating members are grasped and pressed together, the diameter of the clamp is increased allowing the clamp to be slipped on or off the hose. These clamps are referred to in the industry as constant tension clamps and are available from most automotive manufacturers, for example, Chrysler Corporation sells such a clamp identified as MOPAR Part No. 04401439.

Various types of pliers have been used to detach and attach the hose clamp to a hose. Typically, these pliers have special grasping tips at their distal ends for holding the actuating members of the clamp. Each actuating member is shaped slightly different, and in most pliers, if not all, the grasping tips are not identical. Rather, each grasping tip is specially designed to interact with one of the actuating members. This presents a serious problem in situations where the pliers cannot be properly oriented to interact and grip the actuating members of the clamp. Consequently, these prior art pliers are of limited utility because they can not access the clamp in many situations. Typical hose clamp pliers are illustrated in U.S. Pat. No. 5,590,573 and German Patent Publication No. G 92 16 463.3.

SUMMARY OF THE INVENTION

It is the objective of this invention to provide a pliers for constant tension hose clamps which is very compact so that it can be easily utilized within the limited space available inside an automotive engine compartment, and may be used in situations were there is limited accessibility to the clamp.

This invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include a pliers that, although of reduced length, has the capability of gripping constant tension hose clamps of both large and small diameters.

The first feature of the pliers of this invention is that it is especially adapted to remove from an engine hose a constant tension hose clamp that has a diameter that may be enlarged by pressing together a pair of actuating members on the clamp. To facilitate accessing clamps situated in difficult to reach locations, pliers has a total length that is less than 11 inches.

The second feature is that the pliers includes a pair of arms pivotally connected together at intermediate portions of the arms. The arms are generally flat pieces stamped from metal, with each arm having a handle portion and a gripping portion. The gripping portions have opposed ends that are spaced apart a predetermined distance, and each end of the gripping portions has a grasping element. Preferably, the gripping portions are heat treated to harden them. The grasping elements are each adapted to hold one actuating member of the hose clamp, enabling the hose clamp to be held by the grasping elements between the gripping portions to enlarge the diameter of the hose clamp by pressing the handle portions together to press together the pair of actuating members of the clamp.

The third feature is that one of the arms has two separate sections, a gripper section and a handle section which are rigidly connected together by an adjustable rod mechanism, and the other arm has a unitary structure. The adjustable rod mechanism enables the two sections to be moved relative to each other to change the angular relationship between the two sections by adjustment of the rod mechanism. This adjustment varies the distance between the gripping portions to accommodate hose clamps of different diameters.

The fourth feature is that both the gripper section and the handle section of the one arm each have a mounting element. The rod mechanism includes a generally L-shaped arm that has one end connected to the mounting element of the gripper section and another end connected to the mounting element of the handle section. A coiled spring is carried on the L-shaped arm and disposed between the mounting elements. The L-shaped arm has a threaded portion extending outward from the mounting element on the handle section, and a threaded knob connected to the threaded portion of the L-shaped arm, so that rotation of the knob causes the gripping portions of the arms to move relative to each other. Thus, by turning the knob the two sections of the one arm are moved relative to each other to change the angular relationship between these two sections to accommodate hose clamps of different diameters.

The fifth feature is that the pliers may include a locking mechanism for retaining the arms in a stationary position. The locking mechanism engages as the user grips the actuating members of the clamp with the pliers. The user may release his or her grip and the pliers remains in a locked condition holding the clamp between the gripping portions of the pliers.

The sixth feature is that the pliers may employ arms formed to provide between the gripper section and the handle section of each arm an angle in the range of 80 to 140 degrees, preferably substantially 90 degrees. This makes such pliers more compact and versatile. Each gripping portion of each arm is substantially in the same plane as the handle portion of each arm, and the gripping portions of each arm are in substantially the same plane.

The seventh feature is that at the distal end of each gripping portion is a grasping element rotatably mounted thereon. The grasping elements are substantially identical and each grasping element preferably has a friction member which maintains the grasping element in position until manually rotated to another position.

The eighth feature is that is one embodiment of this invention each arm of the handle portions is in substantially the same plane and the gripper portions are in substantially the same plane. These are different planes and the plane of the handle portions and the plane of the gripper portions are in the range of from 10 to 90°, preferably at substantially 45°, with respect to each other.

The ninth feature is that in another embodiment of this invention each distal end of the gripping portions have a grasping element. These grasping elements are which are substantially identical, and preferably are rotatably mounted on the distal ends. In the preferred embodiment each grasping element has a body with a cavity therein with an open mouth sized to receive the first finger. There is a groove adjacent the open mouth sized to receive the yoke, and a tab projecting outward from the body adjacent the groove. The tab is spaced from the open mouth to allow access to the cavity by the first finger. Preferably, each grasping element has a friction member which maintains the grasping element in position until manually rotated to another position. Preferably, the body is substantially cylindrical and has a substantially flat, top surface with the cavity therein having a depth ranging from 1/32 to 3/8 inch. The open mouth preferably has a diameter ranging from 1/4 to 5/8 inch, and the groove adjacent the open mouth preferably has a depth ranging from 1/32 to 1/4 inch. Preferably, tab adjacent to the groove projects outward from the top surface a distance ranging from 1/16 to 1/2 inch. Preferably, the tab has an inside wall which is substantially flush with an inner wall of the groove, and the groove intersects with the open mouth near an edge of the open mouth. Preferably, the cavity is substantially cylindrical and terminates at a closed bottom having a conical configuration.

This invention also includes a method of detaching or attaching a constant tension hose clamp to a hose inside an automotive engine compartment. This clamp has a diameter that may be enlarged by pressing together first and second dissimilar actuating members of the clamp. The method includes (a) providing a pliers for the constant tension hose clamp which comprises first and second arms pivotally connected together at intermediate portions of the arms, each arm having a handle portion and a gripping portion, with said gripping portions each having a distal end with a grasping element rotatably mounted thereon, said grasping elements being substantially identical and each grasping element adapted to hold the first actuating member when in a first position and to hold the second actuating member when in a second position, and (b) rotating the grasping members so that one grasping member is in the first position to grasp the first actuating member and the other grasping member is in the second position to grasp the second actuating member, (c) grasping the actuating members of the hose clamp with the gripping portions of the pliers, inserting the first actuating member in the one grasping element and the second actuating member in the other grasping element, and (d) pressing the handle portions together to move the actuating members toward each other to expand the hose clamp to enable the clamp to be detached or attached to the hose.

DESCRIPTION OF THE DRAWING

The preferred embodiments of this invention, illustrating all its features, will now be discussed in detail. These embodiments depict the novel and non-obvious hose clamp pliers and method of this invention as shown in the accompanying drawing, which is for illustrative purposes only. This drawing includes the following figures (FIGS.), with like numerals indicating like parts:

FIG. 22B is an enlarged fragmentary perspective view taken along line 22B of FIG. 22A.

FIG. 22C is an enlarged fragmentary perspective view taken along line 22C of FIG. 22A.

FIG. 23 is a perspective view of a third embodiment of this invention, which is similar to the second embodiment except that the grasping tips are unique, and each grasping tip is identical in configuration.

FIG. 24 is an enlarged, fragmentary side view, partially in cross-section, showing one of the unique grasping tips of this invention connected to the gripper portion of a pliers' arm.

DETAILED DESCRIPTION OF THE PREFERRED EMBODIMENTS

Figure 3:
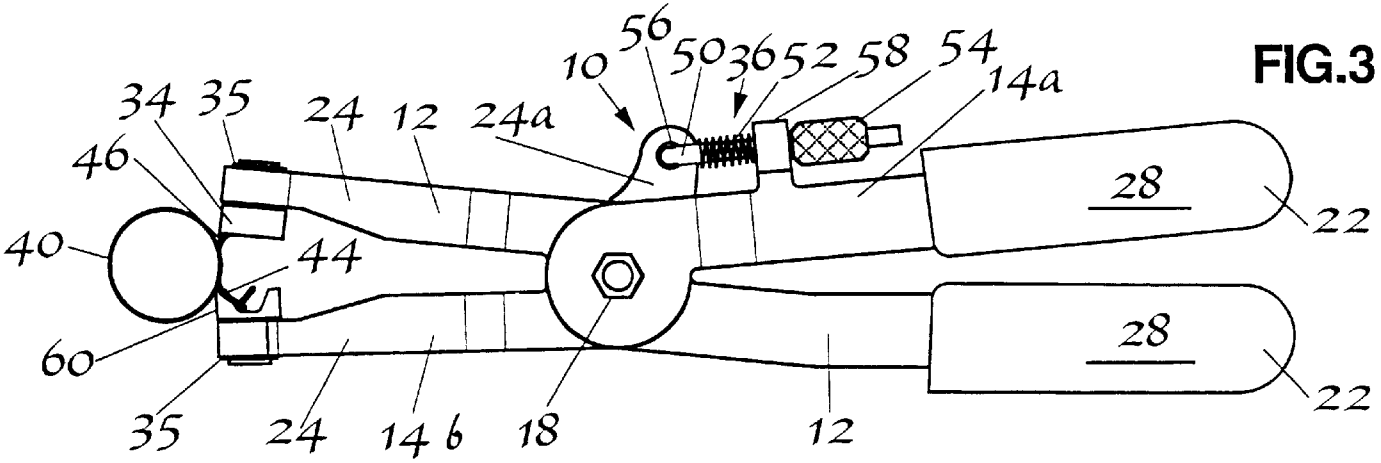
FIG. 3 is a plan view of one side of the adjustable hose clamp pliers of FIG. 1, showing the pliers adjusted to grasp a hose clamp of relatively small diameter.
Figure 4:
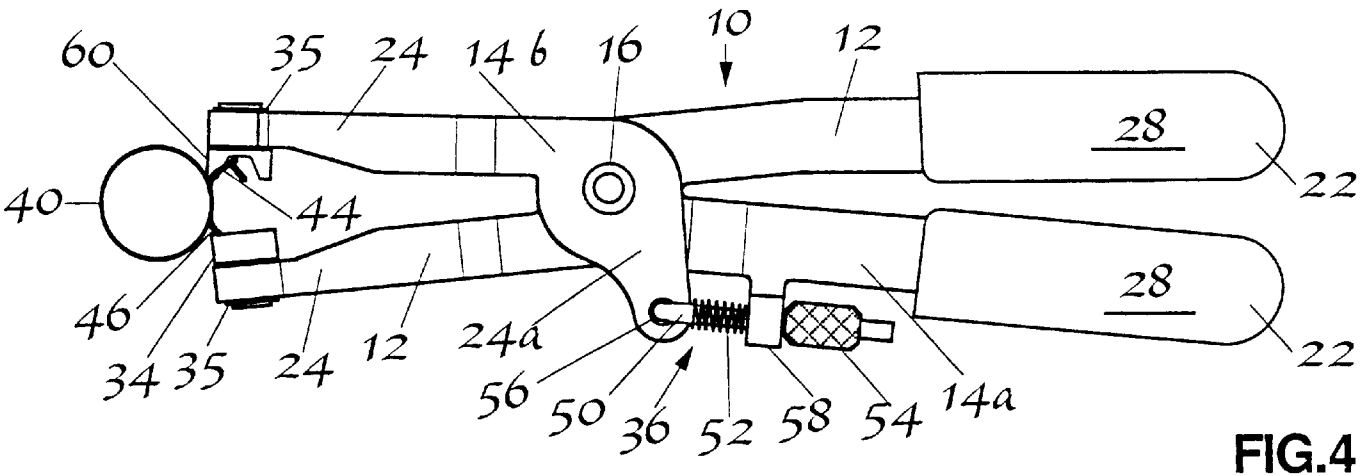
FIG. 4 is similar to FIG. 3, being a plan view of the opposite side of the pliers shown in FIG. 3.
Figure 5:
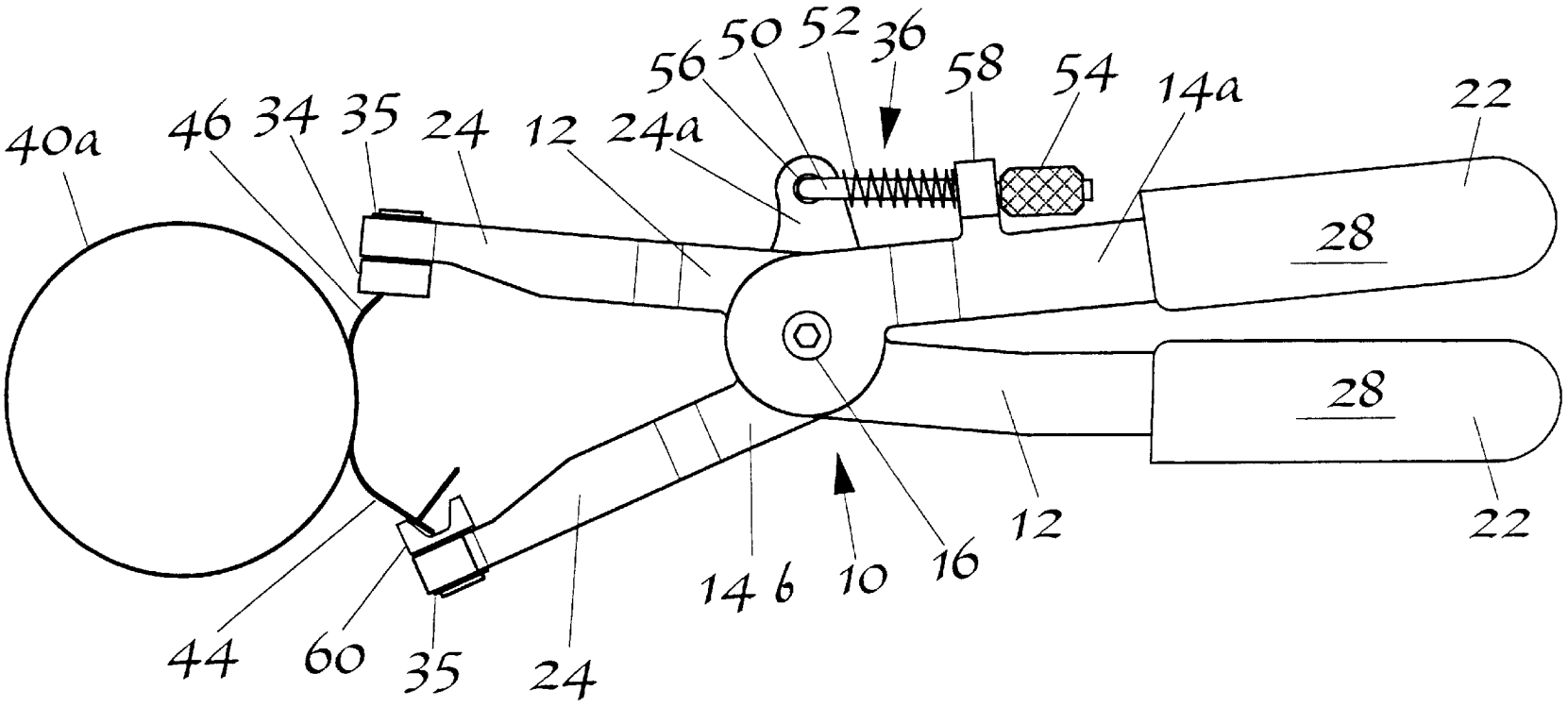
FIG. 5 is a plan view of one side of the adjustable hose clamp pliers of FIG. 1, showing the pliers adjusted to grasp a hose clamp of relatively large diameter.
Figure 6:
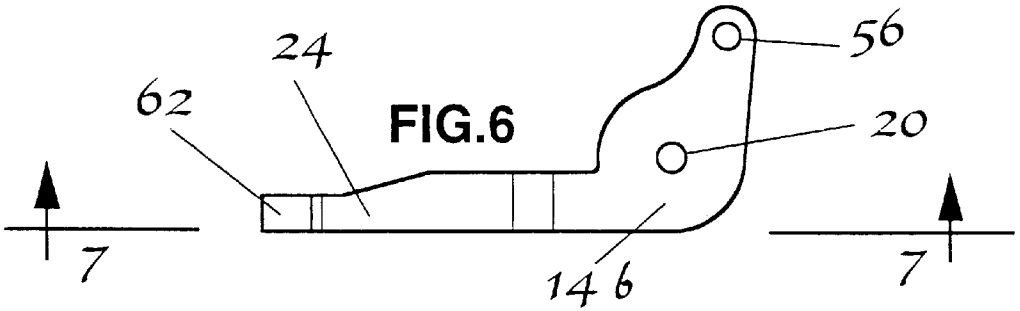
FIG. 6 is a plan view of the gripper portion of the two piece arm of the pliers shown in FIG. 1.
Figure 7:
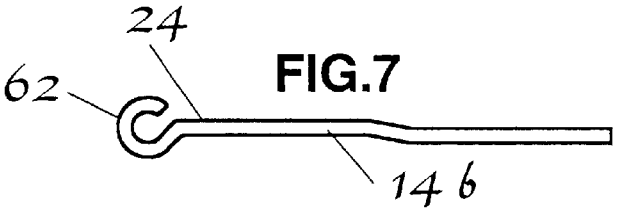
FIG. 7 is a side elevational view taken along line 7—7 of FIG. 6.
Figure 8:
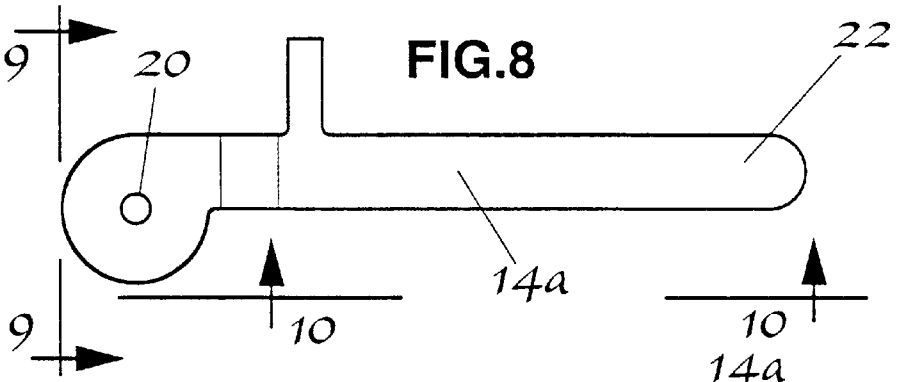
FIG. 8 is a plan view of the handle end of the two piece arm of the adjustable pliers of FIG. 1.
Figure 10:
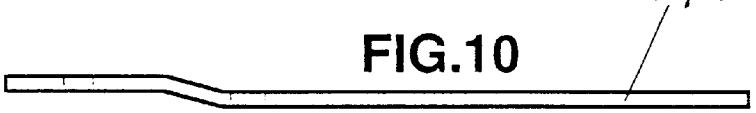
FIG. 10 is a side elevational view taken along line 10—10 of FIG. 8.
Figure 9:
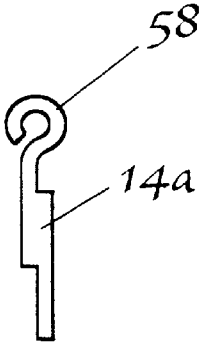
FIG. 9 is an end elevational view taken along line 9—9 of FIG. 8.
Figure 11:
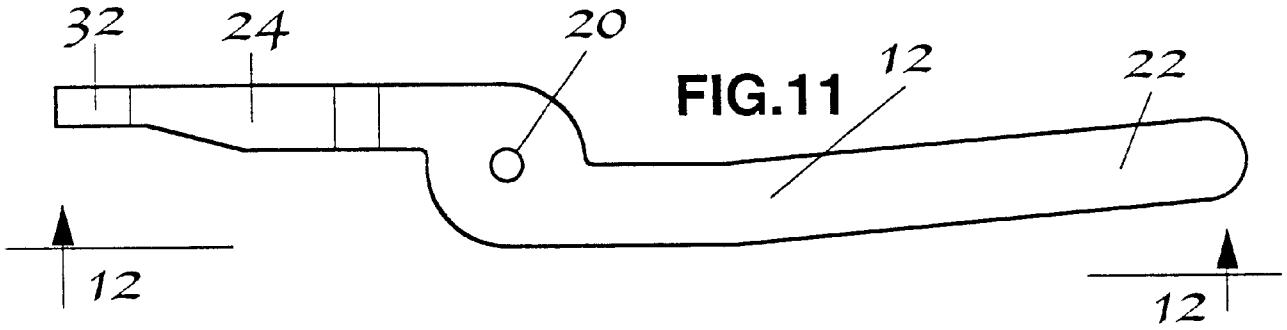
FIG. 11 is a plan view of the one piece arm of the pliers of FIG. 1.
Figure 12:
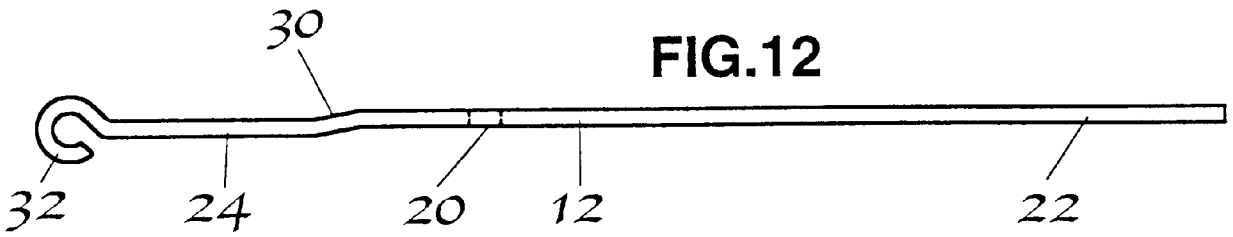
FIG. 12 is a side elevational view taken along line 12—12 of FIG. 11.
Figure 15:
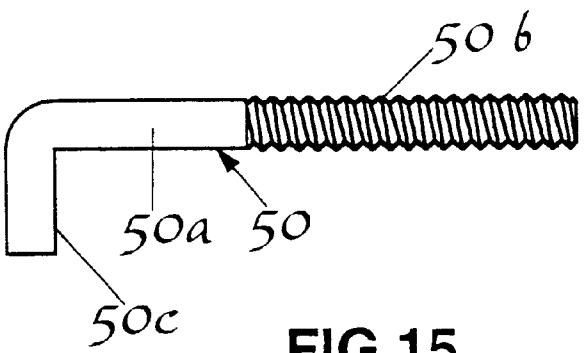
FIG. 15 is a plan view of the L-shaped arm of the rod mechanism.

First Embodiment:

As best shown in FIGS. 1 through 5, the adjustable hose clamp pliers 10 of this invention includes a pair of arms 12 and 14 connected together at intermediate portions by a conventional nut 18 and bolt 16 (or alternately a rivet) through aligned openings 20 in the arms to allow the arms to pivot about the fastener. Each arm 12 and 14 has a handle end 22 and a gripper portion 24 opposite the handle end. The handle ends 22 are preferably equipped with plastic grips 28 (FIGS. 3–5). Alternatively, instead of the arms 12 and 14 being integral, they may each consist of separate handle ends and gripper portions riveted or otherwise connected together.

Figure 14:
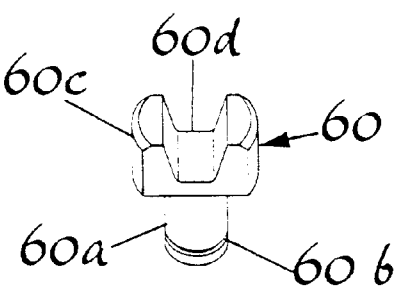
FIG. 14 is a perspective view of the other of the grasping elements.
Figure 13:
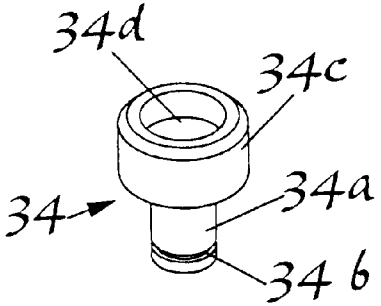
FIG. 13 is a perspective view of one of the grasping elements.

As best shown in FIGS. 1, 2A and 2B, 11, and 12 the one arm 12 comprises a solid unitary piece which is stamped from a metal such as hot or cold rolled steel. This arm 12 is generally flat, but has a slight step portion 30 (FIG. 12) in the gripper portion 24. The end of the gripper portion 24 is twisted into a loop 32 that allows a shaft 34*a* (FIG. 13) of a grasping tip 34 pass through the loop and be attached by a C-clamp 35 that fits in a groove 34*b* in the shaft. This grasping tip 34 has a head 34*c* in the form of a cup 34*d*. The other arm 14 also has a grasping tip 60 attached to a loop 62 at the end of this arm. This grasping tip 60 is similar to the tip 34 in that it also has a shaft 60*a* (FIG. 14) that passes through the loop 62 and it is attached by a C-clamp 35 that fits in a groove 60*b* in the shaft. This grasping tip 34 has a head 34*c* in the form of a cup 34*d*. The main difference is that the head 60*c* of grasping tip 60 has a slot 60*d*. As will be explained in greater detail subsequently, the slot 60*d* and cup 34*d* are adapted to grasp a conventional constant tension hose clamps 40 (FIGS. 3 and 4) and 40*a* (FIG. 5).

Figure 1:
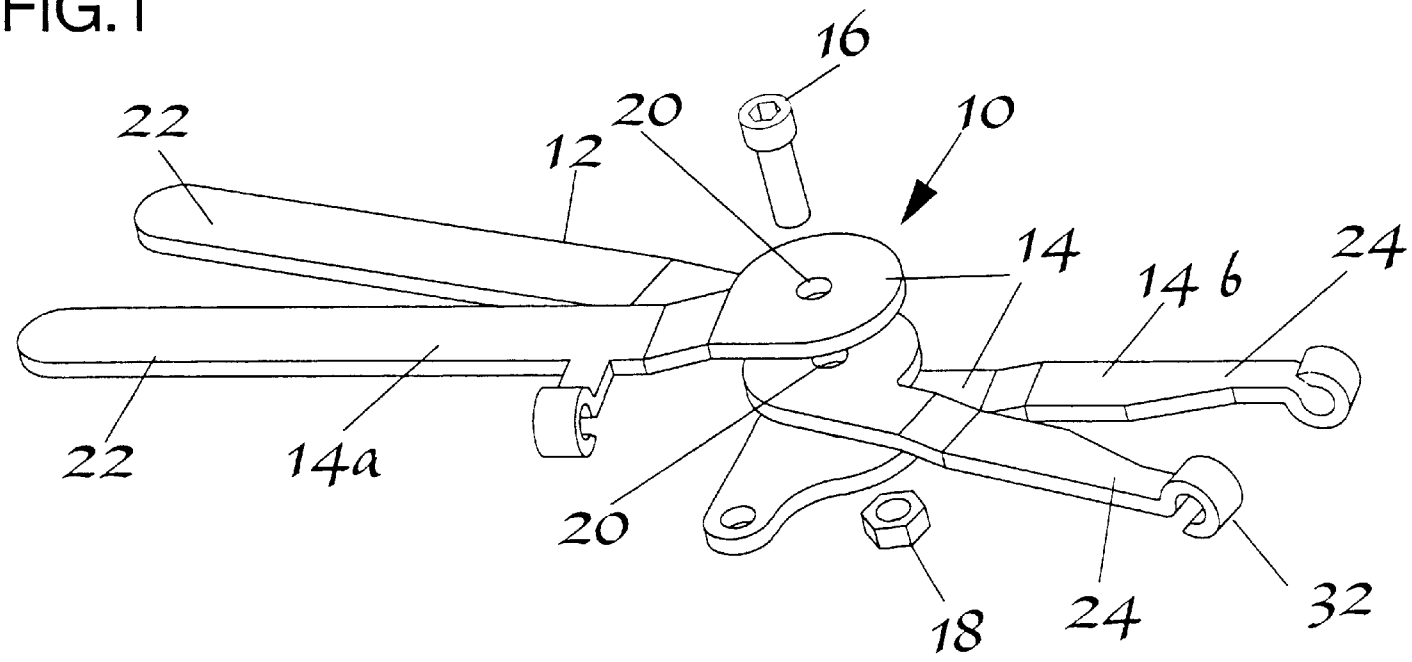
FIG. 1 is an exploded perspective view of the arms, prior to attachment of the grasping elements, of the first embodiment of the pliers of this invention.
Figure 1A:
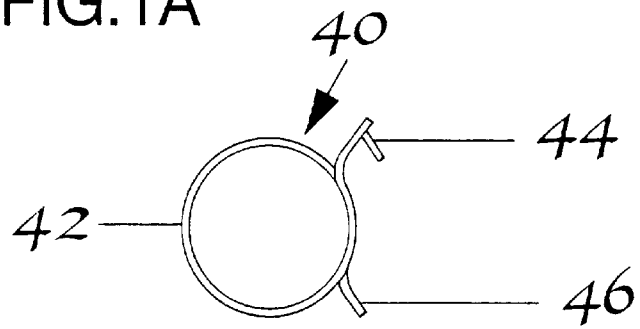
FIG. 1A is a side view of a conventional constant tension hose clamp.
Figure 2A:
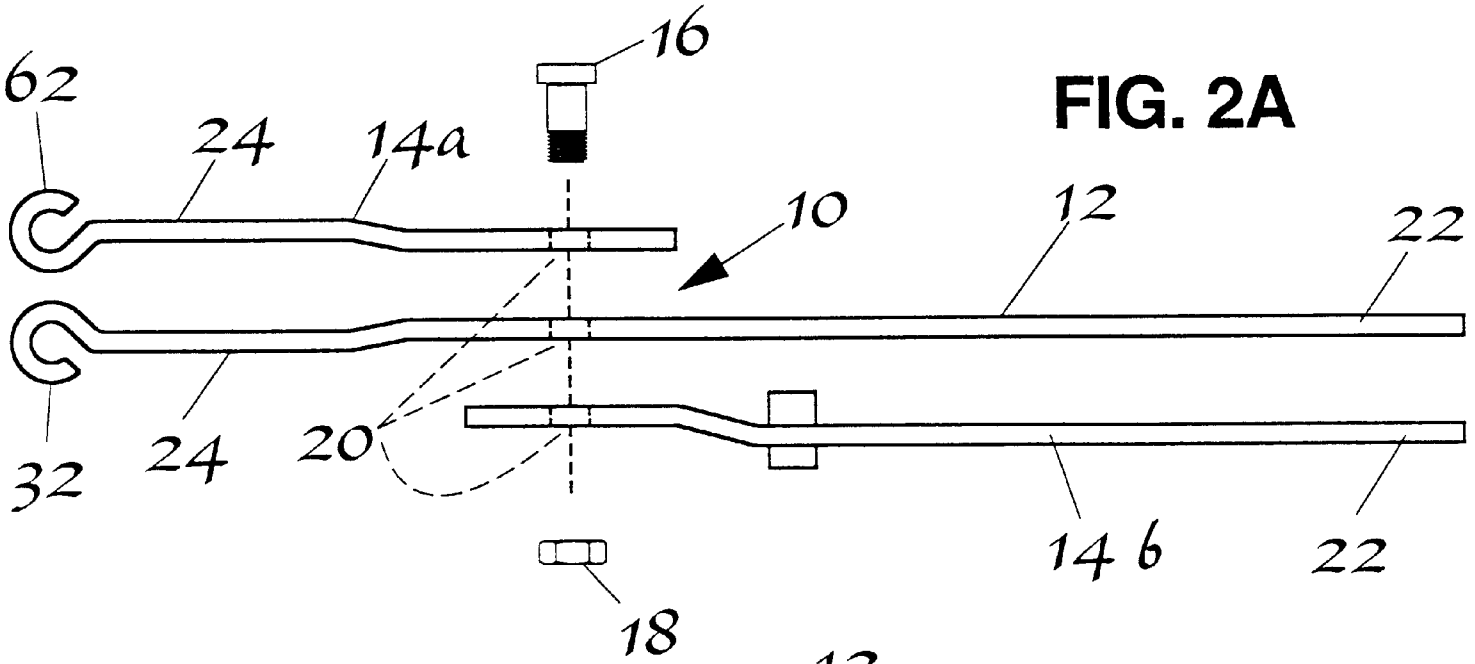
FIG. 2A is a side view of the exploded arms shown in FIG. 1.
Figure 2B:
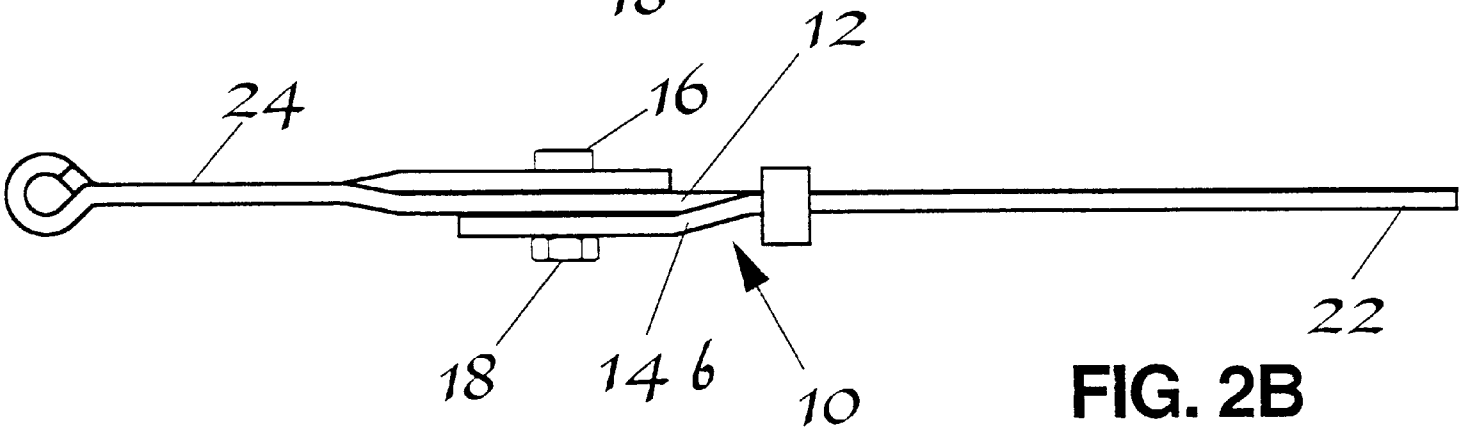
FIG. 2B is a side view showing the arms shown in FIG. 2A connected together.

As best depicted in FIG. 1A, the hose clamp 40 comprises a loop 42 of spring steel formed into a circular structure with actuating members in the form of disconnected free ends 44 and 46. By pushing the ends 44 and 46 together, the diameter of the loop 42 expands, allowing the hose clamp to be slide on and off of an engine hose. As depicted in FIGS. 3 and 5, these hose clamps come in different sizes. The hose clamp 40*a* shown in FIG. 5 has a larger diameter than the hose clamp 40 shown in FIG. 3. The problem this invention solves is to enable one, compact pliers 10 to be used to manipulate both clamps 40 and 40*a*. This is achieved by designing the arm 14 so that the angular relationship between the gripper portion 24 and the handle end 22 by adjusting a rod mechanism 36.

The arm 14 is comprised of two separate sections 14*a* and 14*b* stamped from hot or cold rolled steel. These two arm sections 14*a* and 14*b* are connected together by the adjustable rod mechanism 36 which rigidly connects the arms sections together so that they function as a single unitary structure. Upon adjustment of the rod mechanism, the section 14*a*, which is the gripper portion 24, moves relative to the other section 14*b*, the handle end 22. As will be explained in greater detail subsequently, this allows the pliers 10 to accommodate the different size hose clamps 40 and 40*a*, even though the total length of the pliers 10 is less than 11 inches, preferably about 9.5 or less. If this feature was not present, the pliers 10 would have to be longer, or different size pliers would be required, to attach and detach the hose clamps 40 and 40*a*. Section 14*a* has a length typically ranging between 3.5 inches and 4.5 inches, and the section 14*b* has a length typically ranging between 5 inches and 8 inches. The total length of the pliers is less than 11 inches.

As best shown in FIG. 3–5 and 15, the adjustable rod mechanism 36 comprises a generally L-shaped rod 50, a coiled spring 52 which is carried by the leg 50*a* of the rod, with the rod extending lengthwise through the coiled spring, and a knob 54 with internal threads (not shown) that are threaded onto threads 50*b* on the leg 50*a* of the rod. The gripper portion 24 of the arm section 14*b* has a mounting bracket 24*a* extending outward from an intermediate section of the arm 14. There is a hole 56 in this mounting bracket 24*a* which receives a bent leg 50*c* of the L-shaped rod 50. The other arm section 14*b* also has a mounting bracket generally in the form of a loop 58 which allows the threads 50*b* of the L-shaped rod 50 to pass through this loop. The spring 52 is disposed between the mounting brackets 24*a* and 58 and the knob 54 is screwed onto the threads 50*b* extending outward from the loop 58, i. e., the mounting bracket. Thus, when the knob 54 is rotated in one direction, the spring 52 is compressed between the mounting brackets 24*a* and 58, bringing the gripping portions 24 of the pliers 10 together. When the knob 54 is rotated in the opposite direction, the gripping portions 24 are moved away from each other due to the force of the spring 52. The compression or decompression of the spring 52 moves the gripping arm section 14*b* relative to the handle end section 14*a* to change the angular relationship between these sections of the arm 14 of the pliers 10.

To operate the pliers 10 of this invention, the user places the free ends 44 and 46 of the hose clamp 40 in the grasping tips, end 46 in the cup 34*d* of the grasping tip 34 and end 44 in the slot 60*d* of the grasping tip 60. The distance between the gripper portions 24 at the ends of the arms 12 and 14 is adjusted by means of the rod mechanism 36. The handle ends 22 are separated sufficiently to allow the user to grasp these ends easily with the normal span of his or her hand and press these ends together, causing the gripper portions 24 to come together and press free ends 44 and 46 of the hose clamp 40 together. This pressing action against free ends 44 and 46 expands the diameter of the hose clamp 40 or 40*a* as the case may be. As best shown in FIGS. 3, 4 and 5, when a larger diameter hose clamp 40*a* is employed, the user turns the knob to move the gripper portions 24 away from each other. This allows the larger size diameter hose clamp 40*a* to be manipulated by the pliers 10. This distance between the handle ends 22 remains essentially constant.

Figure 16:
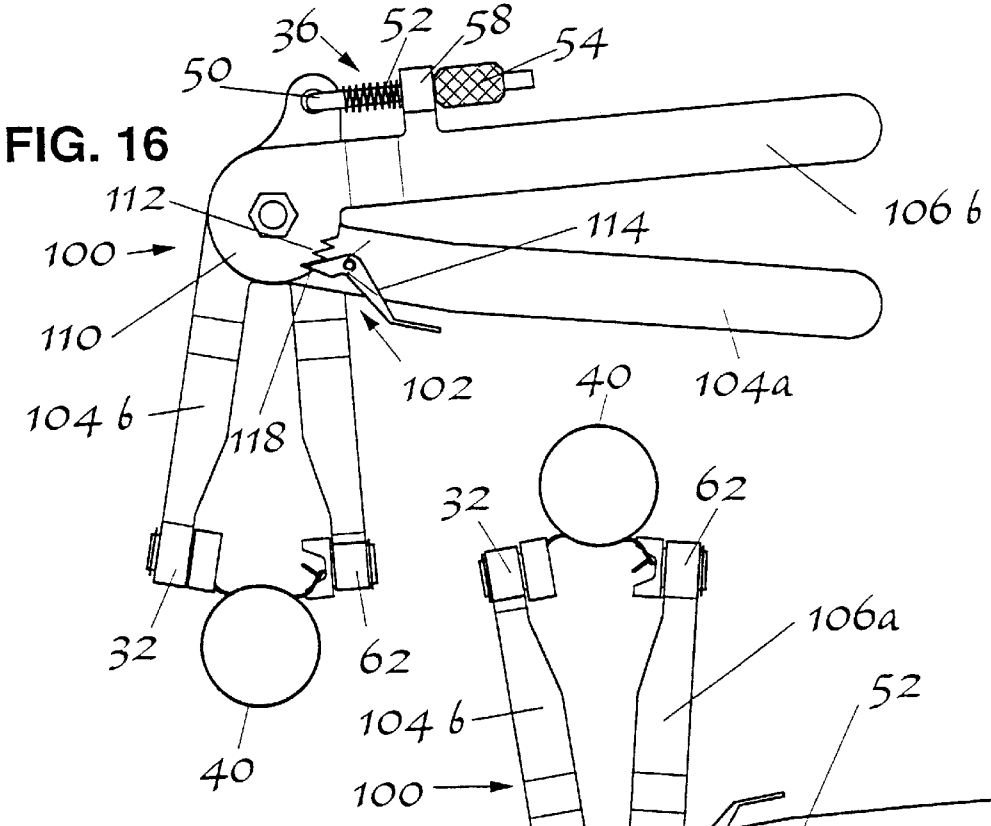
FIG. 16 is a view of one side of a second embodiment of the pliers of this invention.
Figure 17:
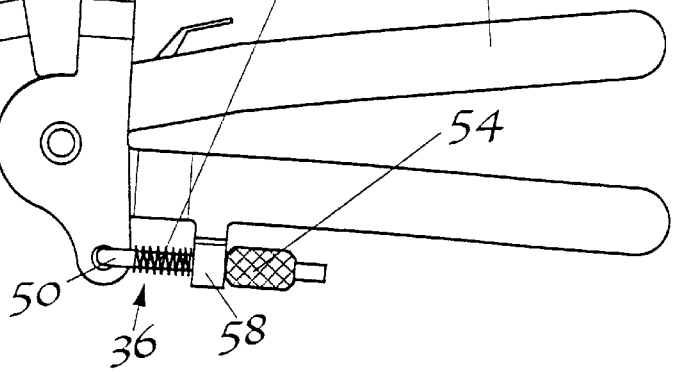
FIG. 17 is a view similar to that shown in FIG. 16, but showing the opposite side of the pliers shown in FIG. 16.
Figure 18:
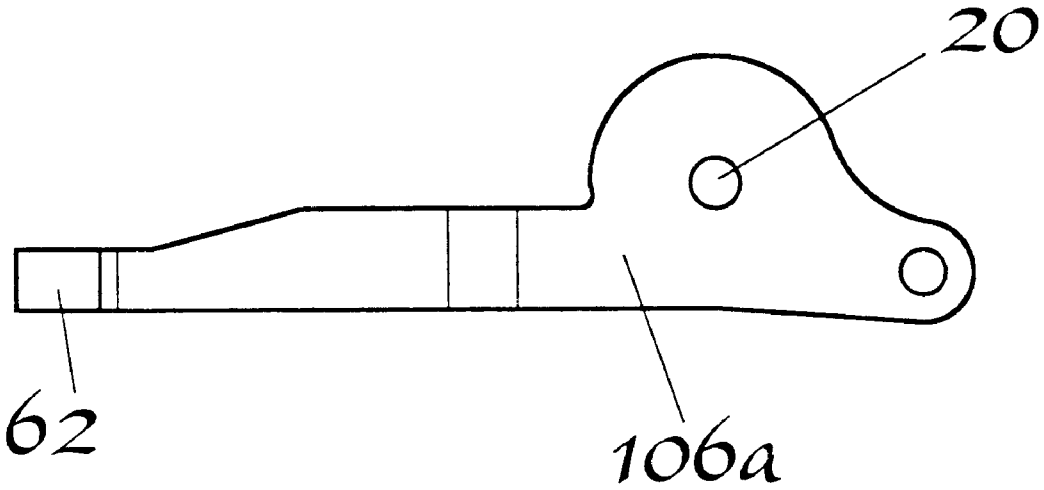
FIG. 18 is a plan view of one section of a two piece arm for the pliers shown in FIG. 16.
Figure 19:
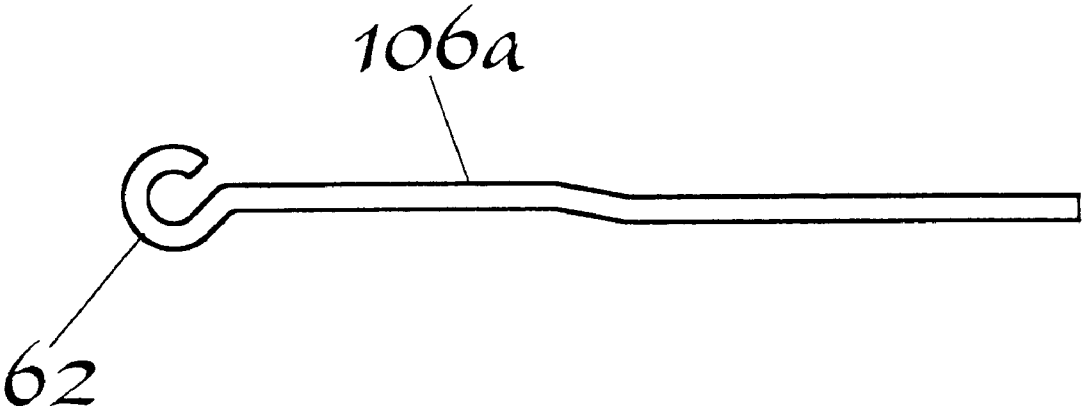
FIG. 19 is an end view of the arm section shown in FIG. 18.
Figure 21:
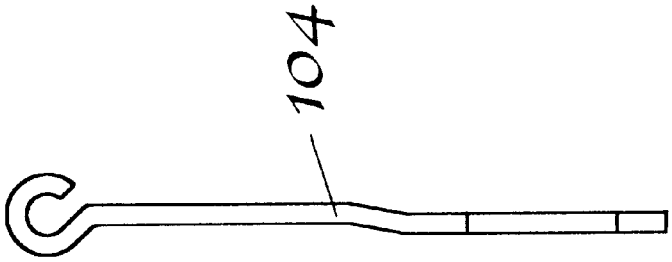
FIG. 21 is an end view of the arm section shown in FIG. 20.
Figure 20:
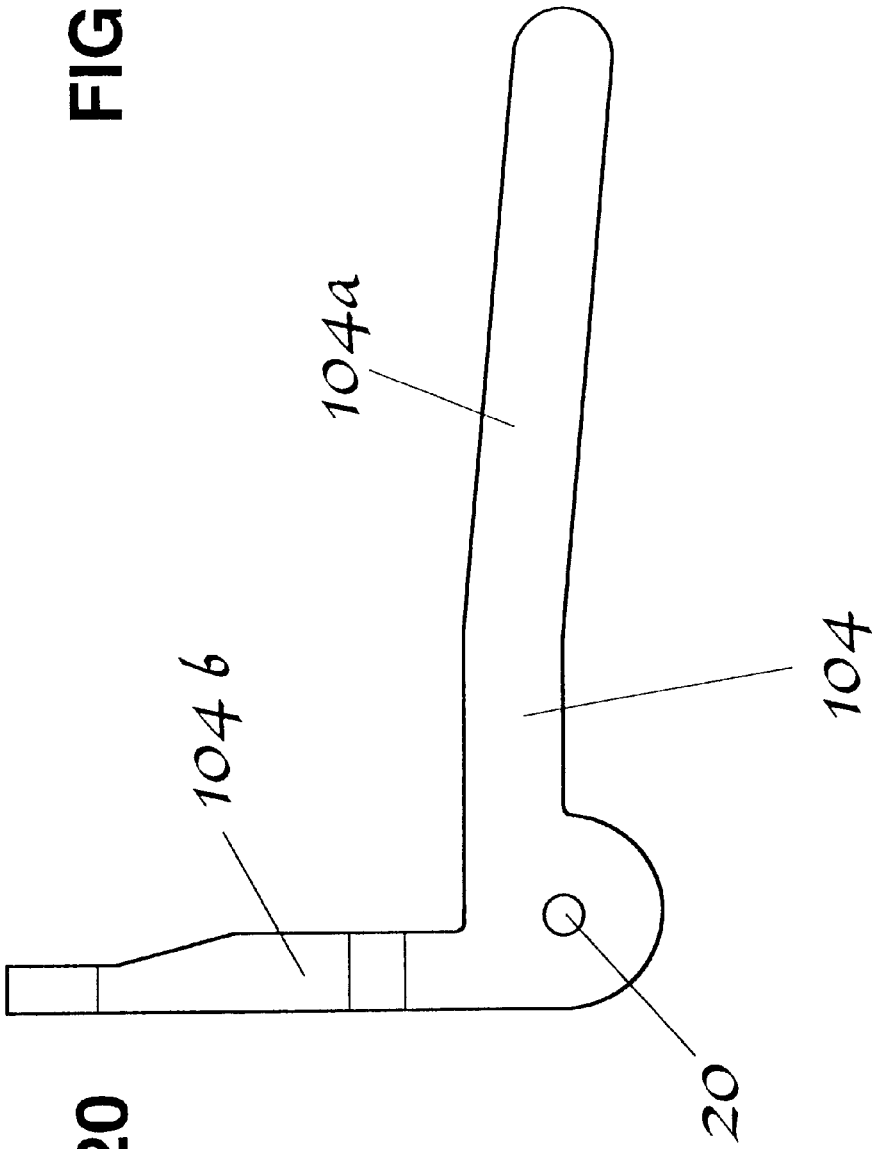
FIG. 20 is a plan view of another section of the two piece arm for the pliers shown in FIG. 16.

Second Embodiment:

FIGS. 16 and 17 illustrate a second embodiment of this invention, the pliers 100, employing a locking mechanism 102 for retaining the arms 104 and 106 in a stationary position. The locking mechanism 102 may be used with either pliers 10 or 100. The arms 104 and 106 are attached to each other at an intermediate position in a manner essentially the same as pliers 10. The main difference between pliers 10 and pliers 100 is the use of angular configured arms 104 and 106, which provides greater compactness and versatility, enabling the users to access the clamp in locations which conventional pliers not so configured cannot access.

The arm 104 preferably has its handle end 104*a* at an angle of about 90 degrees with respect to the gripper portion 104*b*. In all other respect it is essentially the same as the unitary arm 12 of pliers 10. The two piece arm 106 also has a handle end 106*b* at an angle of about 90 degrees with respect to a gripper portion or section 106*a*. The one section 106*a* of the two piece arm 106 is shaped differently than the one section 14*b* of two piece arm 14 of pliers 10, but essentially all other aspects of this section 106*a* are the same as section 14*b* of the arm 14. Each gripping portion 104*b* and 106*a*, respectively, of each arm 104 and 106 is substantially in the same plane as the handle portion 104*a* and 106*b* respectively of the arm to which it is connected, and the gripping portions of each arm are in substantially the same plane.

On the arm 106*b* the edge of the intermediate connecting segment 110 has at least one notch 112 (several are shown, but this is optional). A latch 114 is pivotally attached to the side of the handle end 104*a*, and the tip 118 of this latch interlocks with the notch 112 when the pliers 100 is used to grasp the clamp 40. This holds the pliers 100 in a depressed condition, gripping the clamp 40 until the latch 114 is manually disengaged by pivoting the latch to move the tip 118 from the notch 112.

Third Embodiment:

As shown in FIGS. 23 through 28C, the third embodiment of the pliers of this invention, identified by numeral 200, is similar to the second embodiment in that the gripper portions 202*a* and 204*a* of the pliers' arms 202 and 204, respectively, are oriented at 90 degrees with respect to the handle portions 202*b* and 204*b* of the arms of the pliers. Unlike the second embodiment, no locking mechanism 102 is employed, nor are the gripping tips 34 and 60 employed. In their place, a unique gripping tip 210, as illustrated in FIGS. 24 through 27, is used.

The gripping tips 210 is mounted to rotate at the distal ends 202*a*' and 204*a*' of the gripper portions 202*a* and 204*a* of the arms 202 and 204. Each tip 210 includes a generally cylindrical body member 212 having a shaft 214 extending from the central portion 216*a* of an inner wall 216 of the body member. The shaft 214 of each tip 210 extends respectively through a passageway 218 (FIG. 24) in the distal ends 202*a*' and 204*a*' of the gripper portions 202*a* and 204*a*. A retainer member 220 is force fitted over an end 214*a* of the shaft 214 projecting from the passageway 218 and snapped in a slot 222 at the end 214*a* of each shaft 214, holding the tips 210 to the distal ends 202*a*' and 204*a*', but allowing the tips to be manually rotated. There is a circular indentation 224 along an intermediate portion of each shaft 214 which receives an O-ring 226. This O-ring 226 frictionally engages the inside wall 218*a* (FIG. 24) of the passageway 218. Because the way the grasping tips 210 are attached to the distal ends 202*a*' ands 204*a*', they may be rotated to any desired position by the user, and they will remain in the position selected by the user until again manually rotated to a different position.

The body member 212 has a generally flat top surface 230 with a central cylindrical cavity 232 having a circular open mouth 234 (FIG. 27) at the top surface and terminating in a internal, conical end 236. A groove 238 along the perimeter of the open mouth 234 intersects the mouth, so that the groove is divided into two sections 238*a* and 238*b* (FIG. 27), each on one side of the center C of the cavity 232. Along the outer edge of the body member 212 is a tab 240 which extends generally at a right angle to the top surface 230 and has an inside wall 240*a* which is substantially flush with the inner walls of the groove 238 and cavity 232.

Figure 22:
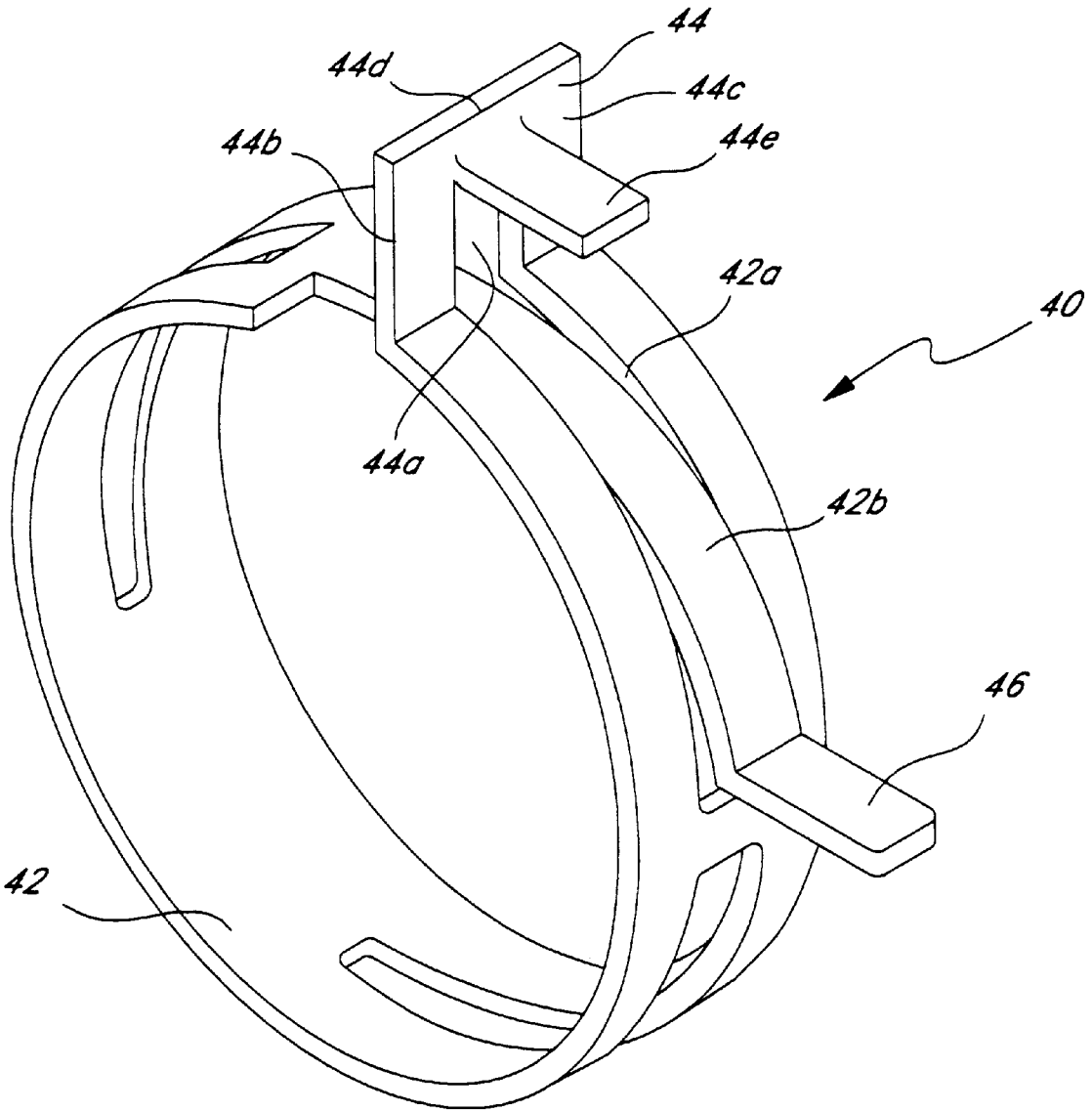
FIG. 22 is a perspective view of a conventional hose clamp.
Figure 22A:
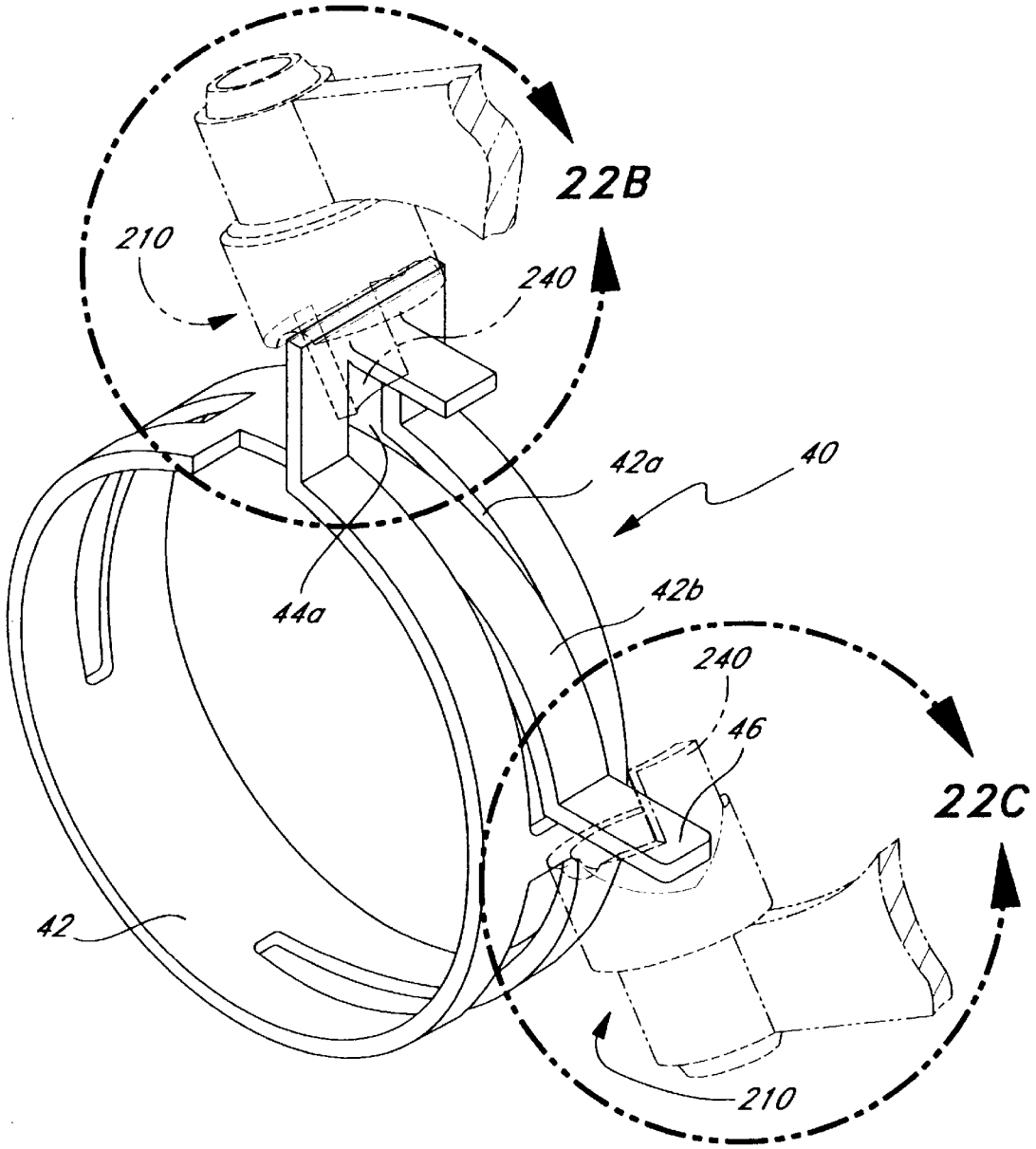
FIG. 22A is a perspective view showing the conventional hose clamp depicted in FIG. 22 depressed and engaging the identical grasping tips (shown in phantom) of a pliers of this invention.
Figure 25:
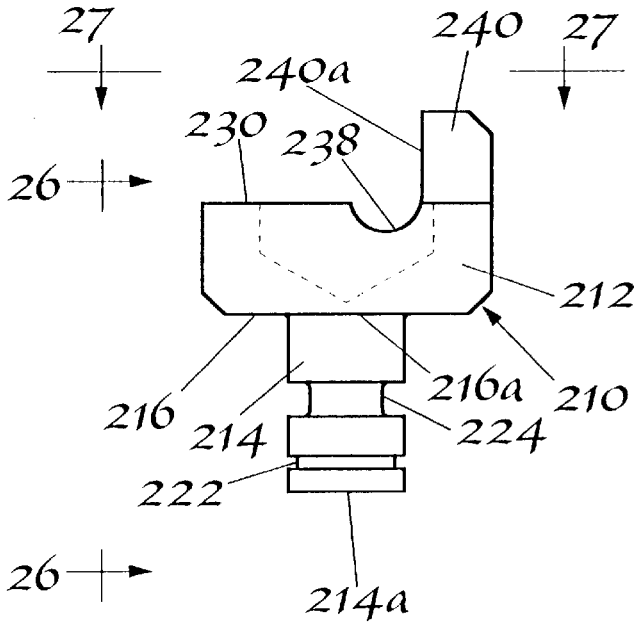
FIG. 25 is a side elevational view of the grasping tip of this invention.
Figure 26:
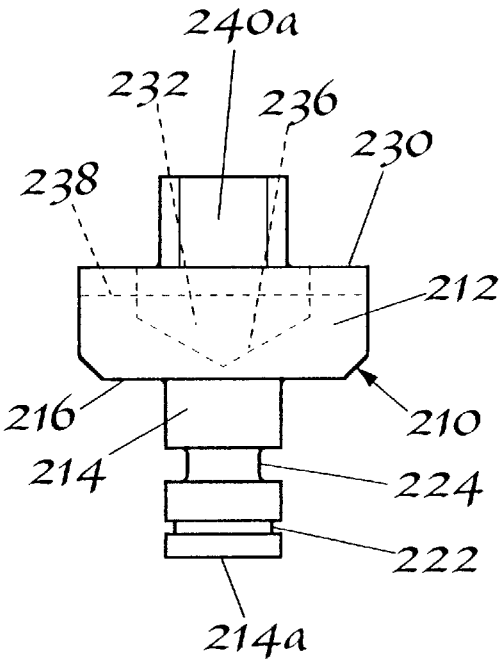
FIG. 26 is a side elevational view taken along line 26—26 of FIG. 25.
Figure 27:
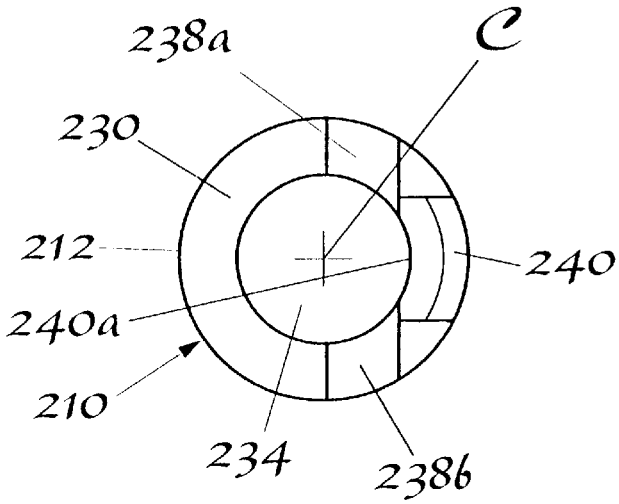
FIG. 27 is a plan view taken along line 27—27 of FIG. 26.

The importance of the shape of the tips 210 is better appreciated by considering how these tips interact with the clamp 40, which is depicted in detail FIG. 22. As discussed above, the hose clamp 40 comprises a loop 42 of spring steel formed into a circular structure with actuating members in the form of disconnected free ends 44 and 46. By pushing the ends 44 and 46 together, the diameter of the loop 42 expands, allowing the hose clamp 40 to be slide on and off of an engine hose. There is a slot 42*a* in the loop 42, with the end portion 42*b* extending through this slot. The end 46 in the form of an actuating finger that is integral with the end portion 42*b*. The end 44 is in the form of a yoke having an open space 44*a* between arms 44*b* and 44*c* of the yoke connected by a cross piece 44*d* having a finger 44*e* extending from it.

Figure 28A:
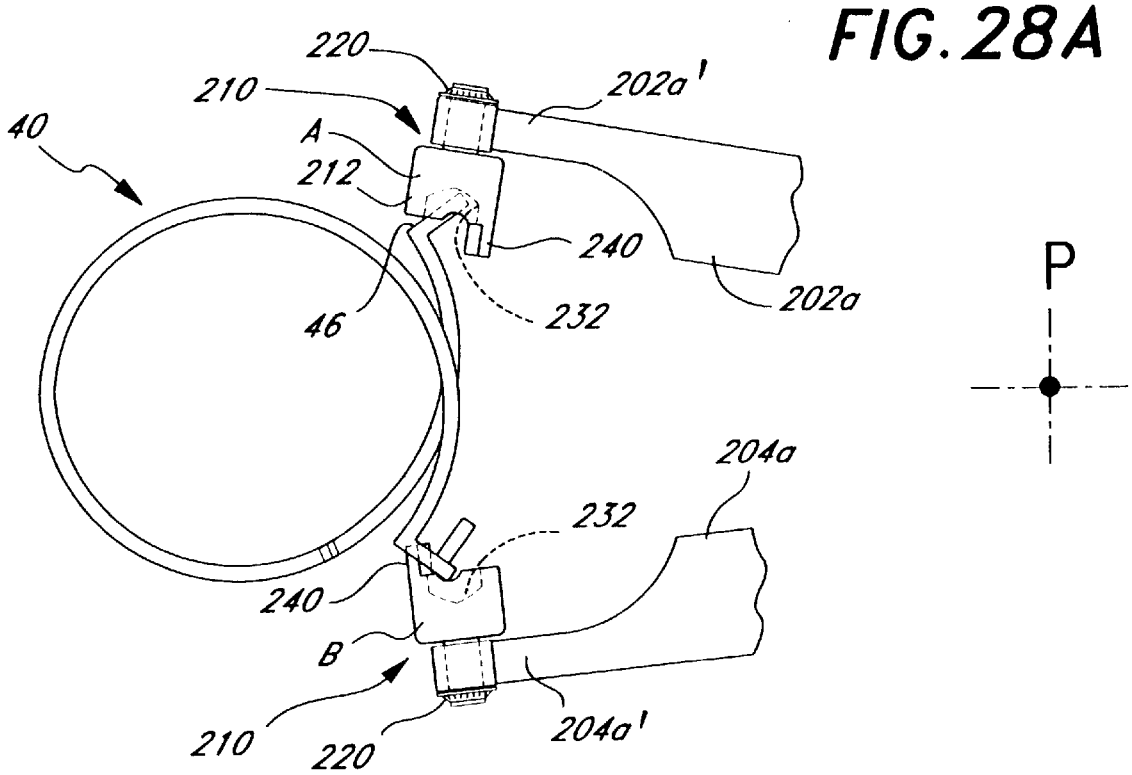
FIG. 28A is a side view showing the pliers depicted in FIG. 23 grasping the hose clamp shown in FIG. 22 with the clamp in one position.
Figure 28B:
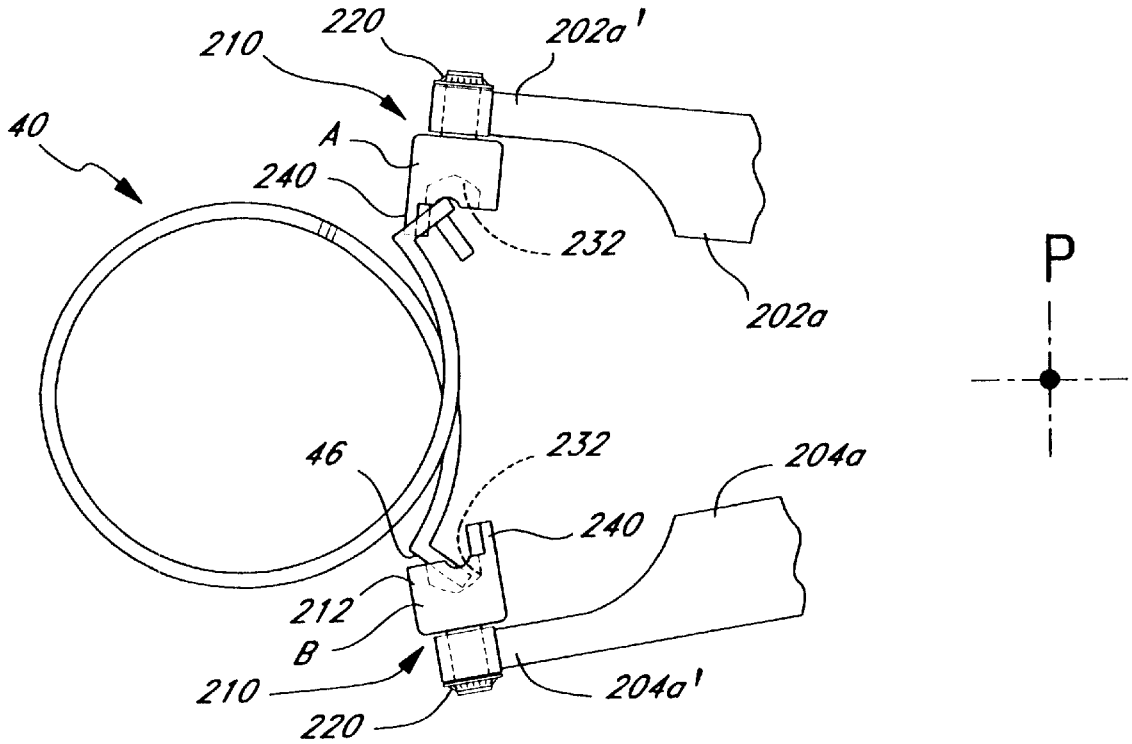
FIG. 28B is a side view similar to that shown in FIG. 28A with the hose clamp in an inverted position from that shown in FIG. 28A, and the grasping tips rotated to the proper positions for effectively gripping the inverted clamp upon depressing it.
Figure 28C:
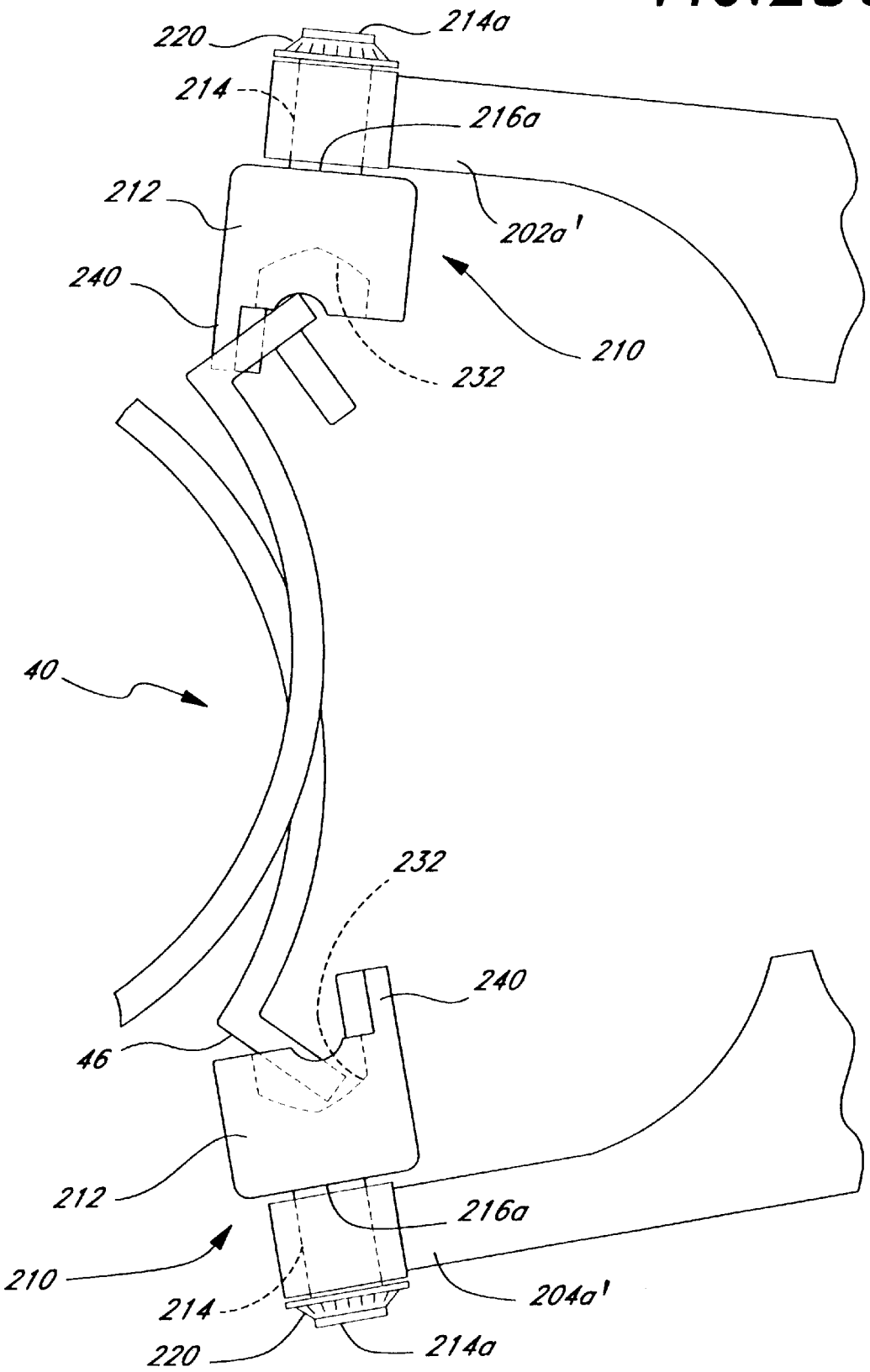
FIG. 28C is an enlarged side view of the clamp engaging the tips which are shown in cross-section.
Figure 28D:
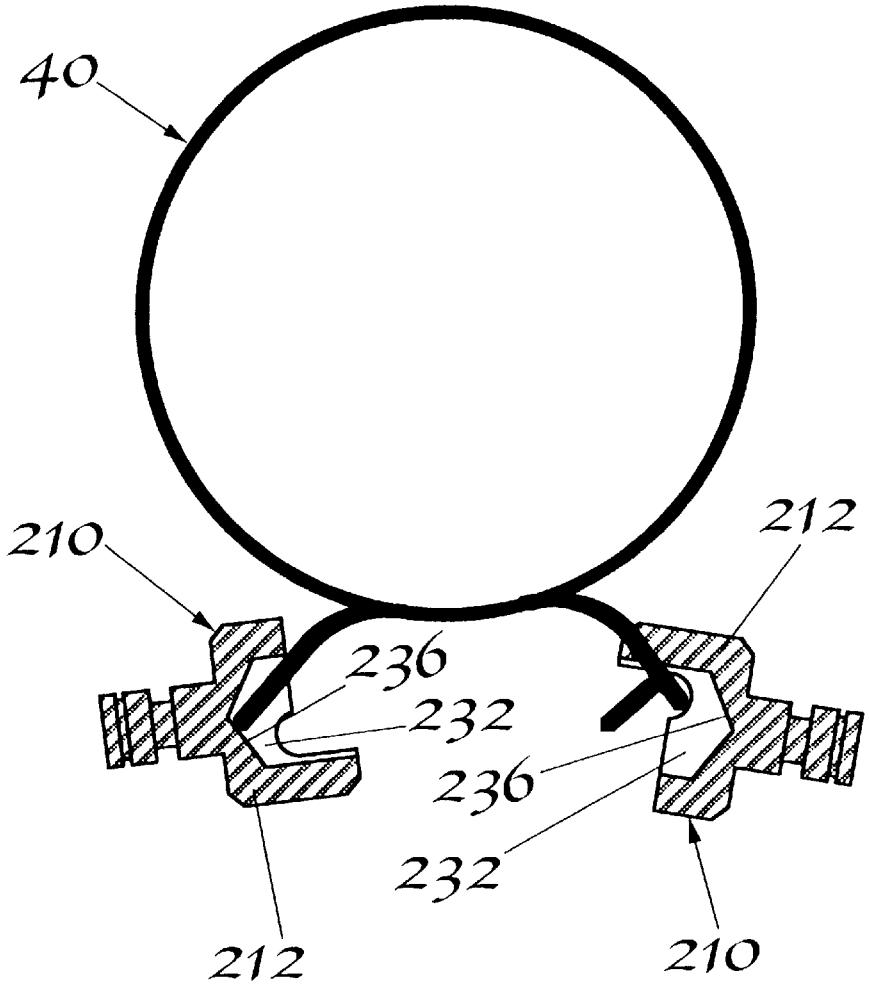
FIG. 28D is an enlarged fragmentary view of the view shown in FIG. 28B.

As shown in FIG. 28A, the grasping tips 210 are first manually rotated so that the tab 240 of the upper tip A is oriented to be close to the pivot point P of the pliers 200, and the tab 240 of the lower grasping tip B is oriented to be at its maximum displacement from the pivot point P. Thus, when the finger end 46 is positioned in the upper tip A as shown in FIGS. 28A and 28D, it is received within the cavity 232, being seated in the conical end 236 of the cavity. The cross piece 44*d* of the yoke end 44 is seated in the groove 238 of the tip B with its finger 44*e* pointing inward towards the pivot point P. Upon depressing the ends 44 and 46 with the grasping tips 210 engaging these ends as depicted in FIGS. 28A and 28D, the tab 240 of the tip interacting with the yoke end 44 slides into the space 44*a* between the arms 44*b* and 44*c* of the yoke end. The other end 46 has a width which is less than the width of the open mouth 234 and it bears against the side walls of the cavity 232. Thus, the ends 44 and 46 do not move in any direction significantly as the diameter of the clamp 40 is being expanding by forcing the ends 44 and 46 to move towards each other due to the pressure applied by the pliers 200. If the hose clamp 40 is in an inverted orientation as shown in FIG. 28B, the gripping tips 210 are simply rotated to reverse their positions, so that they will now interact properly with the clamp 40 as discussed above.

For each arm 202 and 204 of the pliers 200, the handle portion and the gripper portion may be at an angle in the range of from 80 to 140 degrees with respect to each other. Specifically, for the illustrated embodiment, for each arm 202 and 204, the handle portion and the gripper portion are substantially at 90° with respect to each other. Each gripping portion of each arm 202 and 204 is substantially in the same plane as the handle portion of said arm, and the gripping portions of each arm are in substantially the same plane.

Figure 29:
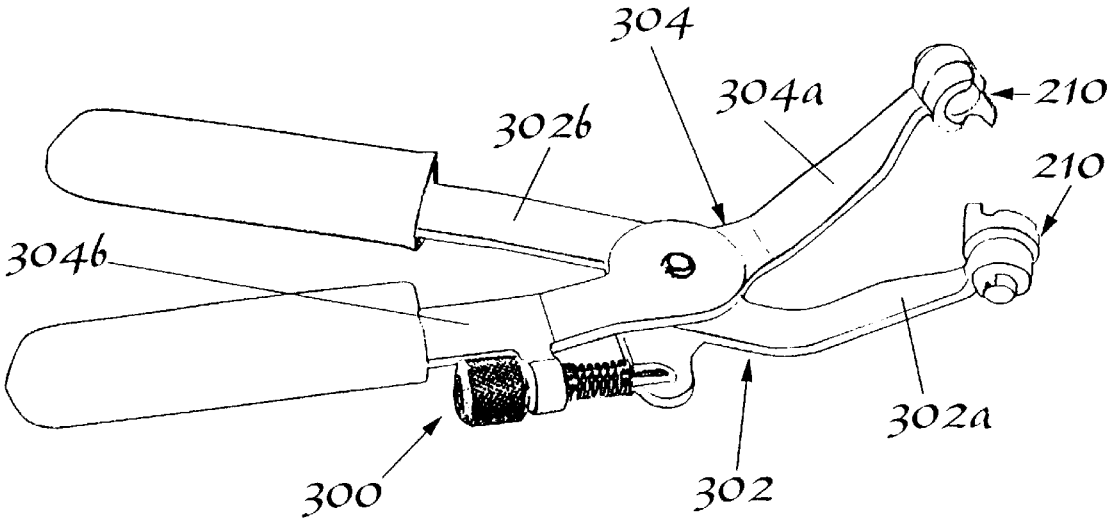
FIG. 29 is a perspective view of a fourth embodiment of this invention.
Figure 30:
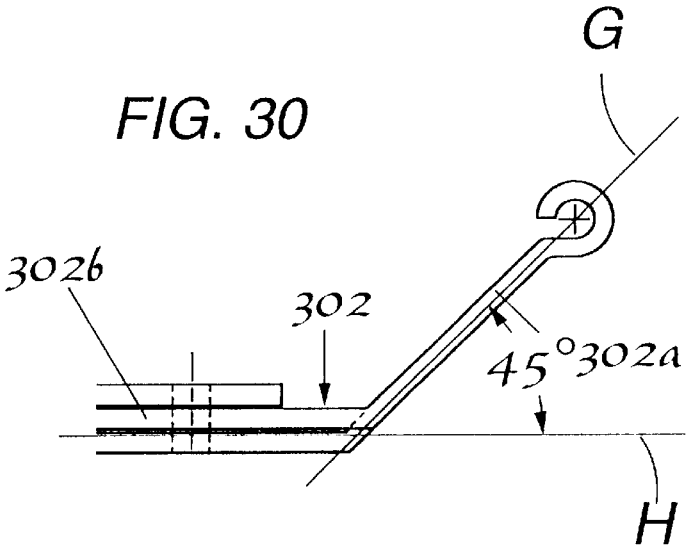
FIG. 30 is a fragmentary plan view of the pliers depicted in FIG. 29 showing the orientation of the gripper portions of the arms of the pliers with respect to the handle portions of the arms.

Fourth Embodiment:

As illustrated in FIGS. 29 and 30, the fourth embodiment of the pliers of this invention is identified by numeral 300. It employs the identical grasping tips 210 as discussed in connection with the third embodiment of this invention. The principal difference between this embodiment and the fourth embodiment is that the gripper portions 302*a* and 304*a*, respectively, of its arms 302 and 304 lie in a different plane than the handle portions 302*b* and 304*b* respectively. Preferably these planes G and H are at an angle of about 45 degrees with respect to each other. In essentially all other respects, the pliers 300 is substantially the same as the pliers 200.

For each arm 302 and 304 of the pliers 300, the handle portions are in the same substantially plane and the gripper portions are in substantially the same plane and the plane of the handle portions and the plane of the gripper portions may be at an angle with respect to each other in the range of from 10° to 90°. The plane of the handle portions and the plane of the gripper portions are at substantially 45° with respect to each other in the illustrated embodiment.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. For example, the pliers may or may not be adjustable to work with hose clamps of varying sizes, or the tips may or may not use the "O" ring for frictionally holding the tips in the selected position. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. A pliers for a constant tension hose clamp which comprises a circular loop-type member having a pair of overlapping clamp ends, each clamp end having an actuating member thereon, with the actuating member at one clamp end having a first finger and the other actuating member at the other clamp end having a yoke formed by spaced apart arms and having a second finger thereon, said clamp having a diameter that may be enlarged by pressing together the actuating members, said pliers including first and second arms pivotally connected together at intermediate portions of the arms, each arm having a handle portion and a gripping portion, with said gripping portions each having a distal end, each distal end of said gripping portions having a grasping element rotatably mounted thereon, with said grasping elements being substantially identical in size and configuration and each grasping element comprising a body with a cavity therein with an open mouth sized to receive the first finger, a groove adjacent the open mouth sized to receive the yoke, and a tab projecting outward from the body adjacent to the groove and sized to be received between the arms of the yoke, said grasping elements each having a friction member which maintains the grasping element in position until manually rotated to another position.

2. The pliers of claim 1 where the tab is spaced from the open mouth to allow access to the cavity by the first finger, and the friction member is an O-ring which maintains the grasping element in position until manually rotated to another position.

3. The pliers of claim 1 where the first arm has two separate sections, a gripper section and a handle section which are rigidly connected together by an adjustable rod mechanism that enables the two sections to be moved relative to each other to change the angular relationship between the two sections by adjustment of the rod mechanism, thereby varying the distance between the gripping portions to accommodate hose clamps of different diameters.

4. The pliers of claim 1 where for each arm the handle portion and the gripper portion are at an angle of from 80 to 140 degrees with respect to each other.

5. The pliers of claim 4 where for each arm the handle portion and the gripper portion are substantially at 90° with respect to each other.

6. The pliers of claim 1 where for each arm the handle portions are in the same substantially plane and the gripper portions are in substantially the same plane and the plane of the handle portions and the plane of the gripper portions are at an angle with respect to each other in the range of from 10° to 90°.

7. The pliers of claim 6 where the plane of the handle portions and the plane of the gripper portions are at substantially 45° with respect to each other.

8. An improved pliers for a constant tension hose clamp which has a diameter that may be enlarged by pressing together a pair of actuating members of said clamp, where said pliers includes first and second arms pivotally connected together at intermediate portions of the arms, each arm having a handle portion and a gripping portion, with said gripping portions each having a distal end, each distal end of said gripping portions having a grasping element, with each grasping element adapted to hold one actuating member of the hose clamp, enabling the hose clamp to be held by the grasping elements between the gripping portions to enlarge the diameter of the hose clamp by pressing the handle portions together to press together the pair of actuating members of the clamp, said improvement comprising each gripping portion of each arm being substantially at 90° with respect to the handle portion of said arm, each handle portion of each arm being substantially straight and each gripping portion of each arm being substantially straight, and said grasping elements being substantially identical in size and configuration and each grasping element comprising a body with a cavity therein with an open mouth sized to receive the first finger, a groove adjacent the open mouth sized to receive the yoke, and a tab projecting outward from the body adjacent to the groove and sized to be received between the arms of the yoke, said grasping elements each having a friction member which maintains the grasping element in position until manually rotated to another position.

9. The improved pliers of claim 8 where each gripping portion of each arm is substantially in the same plane as the handle portion of said arm.

10. The improved pliers of claim 8 where the gripping portions of each arm are in substantially the same plane.

11. The improved pliers of claim 8 including a locking mechanism for retaining the arms in a stationary position.

12. The improved pliers of claim 8 where the first and second arms are generally flat pieces stamped from metal.

13. The improved pliers of claim 8 where the gripping portions are heat treated to harden said gripping portions.

14. The improved pliers of claim 8 where the first arm has two separate sections, a gripper section and a handle section which are rigidly connected together by an adjustable rod mechanism that enables the two sections to be moved relative to each other to change the angular relationship between the two sections by adjustment of the rod mechanism, thereby varying the distance between the gripping portions to accommodate hose clamps of different diameters.

15. The improved pliers of claim 14 where both the gripper section and the handle section of said first arm each has a mounting element, and the rod mechanism includes a generally L-shaped arm that has one end connected to the mounting element of the gripper section and another end connected to the mounting element of the handle section, a coiled spring carried on the L-shaped arm and disposed between the mounting elements, said L-shaped arm having a threaded portion extending outward from the mounting element on the handle section, and a threaded knob connected to the threaded portion of the L-shaped arm, so that rotation of the knob causes the gripping portions of the first and second arms to move relative to each other.

16. An improved pliers for a constant tension hose clamp which has a diameter that may be enlarged by pressing together a pair of actuating members of said clamp, where said pliers includes first and second arms pivotally connected together at intermediate portions of the arms, each arm having a handle portion and a gripping portion, with said gripping portions each having a distal end, each distal end of said gripping portions having a grasping element, with each grasping element adapted to hold one actuating member of the hose clamp, enabling the hose clamp to be held by the grasping elements between the gripping portions to enlarge the diameter of the hose clamp by pressing the handle portions together to press together the pair of actuating members of the clamp, said improvement comprising each gripping portion of each arm being substantially at 90° with respect to the handle portion of said arm and each gripping portion of each arm being substantially in the same plane as the handle portion of said arm, with the gripping portions of each arm being in substantially the same plane, and each handle portion of each arm being substantially straight and each gripping portion of each arm being substantially straight, and said grasping elements being substantially identical in size and configuration and each grasping element comprising a body with a cavity therein with an open mouth sized to receive the first finger, a groove adjacent the open mouth sized to receive the yoke, and a tab projecting outward from the body adjacent to the groove and sized to be received between the arms of the yoke, said grasping elements each having a friction member which maintains the grasping element in position until manually rotated to another position.

17. A pliers for a constant tension hose clamp which comprises a circular loop-type member having a pair of overlapping clamp ends, each clamp end having an actuating member thereon, with the actuating member at one clamp end having a first finger and the other actuating member at the other clamp end having a yoke formed by spaced apart arms and having a second finger thereon, said clamp having a diameter that may be enlarged by pressing together the actuating members, said pliers including first and second arms pivotally connected together at intermediate portions of the arms, each arm having a handle portion and a gripping portion, with said gripping portions each having a distal end with a passageway extending there through, each distal end of said gripping portions having a grasping element rotatably mounted thereon, with said grasping elements being substantially identical in size and configuration and each grasping element comprising a substantially cylindrical body having an substantially flat top and an inner wall with a shaft extending therefrom into the passageway in the distal end to which it is attached, a cavity in the cylindrical body with an open mouth at the flat top, said open mouth having a center and a perimeter sized so that said mouth is adapted to receive the first finger, a groove along the perimeter of the open mouth sized to receive the yoke, said groove intersecting the open mouth so it is divided into two sections each on one side of the center of the open mouth, and a tab adjacent to the groove positioned between the two sections of the groove, said tab projecting outward from the flat top and sized to be received between the arms of the yoke.

18. The pliers of claim 17 where the shafts of each grasping element has an indentation therein with a friction member seated therein that makes contact with the passageway in the distal end to which the grasping element is attached, said friction member maintaining the grasping element in position until manually rotated to another position.

19. The pliers of claim 18 where the friction member is an O-ring.

20. The pliers of claim 17 where the tab is substantially at a right angle to the flat top.

* * * * *